United States Patent [19]

Keller

[11] 3,930,390

[45] Jan. 6, 1976

[54] ESPAGNOLETTE LOCK

[76] Inventor: Ernst Keller, 6 Querstrasse, 8805 Richterswil, Switzerland

[22] Filed: Aug. 28, 1974

[21] Appl. No.: 501,286

[30] Foreign Application Priority Data

Aug. 30, 1973 Switzerland ..... 12463/73

[52] U.S. Cl. ..... 70/224; 70/370; 70/371; 70/451

[51] Int. Cl.[2] ..... E05B 9/08

[58] Field of Search ..... 70/117, 224, 346, 367, 70/370, 371, 451, 453; 292/349

[56] References Cited

UNITED STATES PATENTS

| | | | |
|---|---|---|---|
| 619,202 | 2/1899 | Mirot | 70/134 |
| 1,026,209 | 5/1912 | Keppec | 70/453 X |
| 1,561,254 | 11/1925 | Ledin | 70/370 |
| 2,079,583 | 5/1937 | Brauning | 70/224 |
| 2,307,106 | 1/1943 | Brush | 70/367 X |
| 3,733,865 | 5/1973 | Vorob | 70/451 X |
| 3,745,795 | 7/1973 | Sanders | 70/451 |
| 3,863,471 | 2/1975 | Keller-Volper | 70/370 X |

FOREIGN PATENTS OR APPLICATIONS

| | | | |
|---|---|---|---|
| 364,193 | 10/1962 | Switzerland | 292/5 |
| 727,002 | 10/1942 | Germany | 70/370 |
| 1,376,584 | 9/1964 | France | 70/451 |

*Primary Examiner*—Roy D. Frazier
*Assistant Examiner*—Thomas J. Holko
*Attorney, Agent, or Firm*—Haseltine, Lake & Waters

[57] ABSTRACT

An espagnolette lock having an actuating nut which is rotatably supported in a lock box and in a lock box cover, which includes a rectangular through-aperture for receiving a rectangular arbor, and a slot formed in one side of the nut body of the nut for receiving the key bit of a cipher key. A sleeve is fastened to the lock box cover, which is adapted to extend into a circular aperture formed in the door or the like, and in which the sleeve is provided with guide slots and/or projections for receiving and securely fastening different types of actuating members or fittings for the lock, and their respective guide and covering sleeves.

7 Claims, 10 Drawing Figures

1
4
4
2
9a
14
19
20
14
15
9
16
18
3
14
8
17

27
26
25
21
28

25
24
23
22a
19a
26
28
22
31

33
32
28
35
31
34

37
38
36a
36
37a

ESPAGNOLETTE LOCK

FIELD OF THE INVENTION

The present invention relates to an espagnolette lock having an actuating nut which is rotatably supported in a lock box and in a lock box cover, which includes a rectangular throughaperture for receiving a rectangular arbor, and a slot formed in one side of the nut body of the nut for receiving the key bit of a cipher key.

DISCUSSION OF THE PRIOR ART

A lock of the above-mentioned type is disclosed in applicants U.S. patent application Ser. No. 408,001, filed Oct. 19, 1973, now U.S. Pat. No. 3,863,471. Among other advantages it provides that, without changing the basic construction thereof, the lock may be adapted for acutation by means of a cipher key, a safety cylinder, a cylinder olive or rotary grip, wherein merely the auxiliary fittings need be interchanged.

In the presently employed construction of the lock, these auxiliary fittings had to be assembled with the lock prior to the latter being mounted on a door. Thus, for example, manufacturers had the capability of providing the door of a cabinet with a lock adapted for actuation by means of a cipher-bit key and to then place the cabinet into storage. However, if a purchaser required a different type of actuation for the lock such as, for example, a safety cylinder, the lock had to be again dismounted and refitted. Additionally, the type of fastening of the lock to the door, as heretofore known, was effected by means of four screws, which required a considerable amount of labor.

SUMMARY OF THE INVENTION,

Accordingly, it is an object of the present invention to provide a lock of the above-mentioned type which is constructed so as to, on the one hand, simplify the mounting thereof on the door, for example, in order to permit it to be carried out automatically and, on the other hand, to allow assembly of the varied types of actuating components for the lock, such as a cipherbit key, safety cylinder, cylinder olive or rotary grip subsequent to the mounting of the basic lock structure on a door.

The foregoing object is inventively achieved in that a sleeve or receptacle is fastened to the lock box cover, which is adapted to extend into a circular aperture formed in the door or the like, and in which the sleeve is provided with guide slots and/or projections for receiving and securely fastening the different types of actuating members or fittings for the lock, and their respective guide and covering sleeves.

A preferred embodiment of the inventive espagnolette lock is characterized in that the sleeve includes plastically deformable spreader lugs for effecting fastening thereof within the aperture formed in the door or the like.

Through the foregoing is accomplished that for the fastening of the lock on a door, the latter must be provided with a single through-aperture. The sleeve, which is connected with the lock box, is then introduced into this aperture, and is fastened from the opposite side thereof through outward bending of the spreader lugs. The door, and possibly the therewith associated cabinet, may then be placed into storage, and the actuating fitting which is desired by a subsequent purchaser may then be subsequently built into the sleeve from exteriorly to the door. In this manner, the most economical and simple completion of cabinets becomes possible.

BRIEF DESCRIPTION OF THE DRAWINGS

Reference may now be had to an exemplary embodiment of the invention, taken in conjunction with the accompanying drawings; in which.

DETAILED DESCRIPTION

Figure 1:
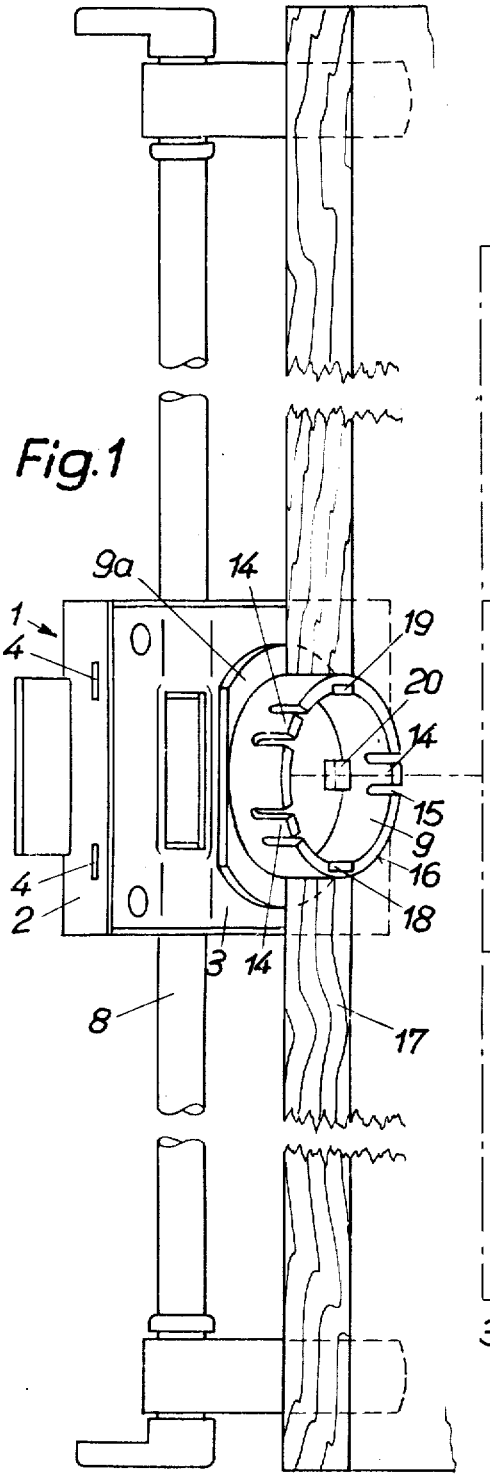
FIG. 1 illustrates an espagnolette lock adapted to be mounted in a door, for use with different types of actuating members as shown in FIGS. 1*a* through 1*d*, and which may be subsequently assembled therewith.
Figure 2:
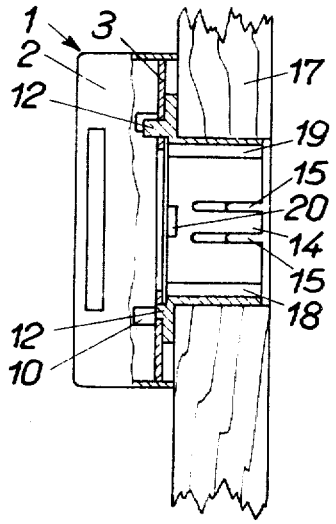
FIG. 2 is a longitudinal sectional view through a door having the lock of FIG. 1 mounted thereon.

Referring to FIGS. 1 and 2 of the drawing, there may be ascertained that an espagnolette lock 1, whose inner construction is not illustrated since it does not relate to the present invention, includes a lock box 2 having a cover 3 which, in a known manner, is fastened in the lock box 2 by means of lugs 4. From FIG. 6 there may further be ascertained a nut 5, which is rotatably supported in the wall of the box and in cover 3, and which may be pivoted about its axis upon rotation of a locking rod 8 is displaced about its longitudinal axis. The internal construction of the lock is described in copending U.S. application Ser. No. 408,001.

Figure 3:
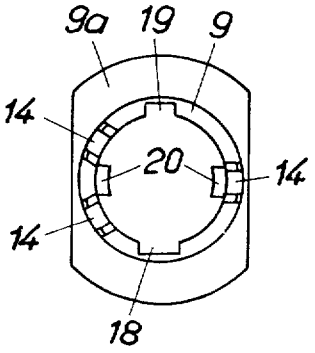
FIG. 3 is a plan view of the front side of the lock sleeve.
Figure 4:
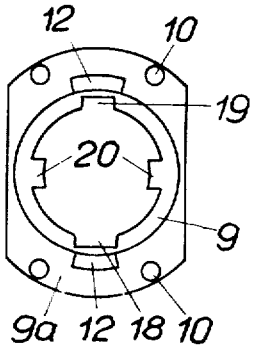
FIG. 4 is a plan view of the rear side of the lock sleeve.

A sleeve 9 is fastened in the cover 3, shown individually in FIGS. 3 and 4. The sleeve 9 includes a flange 9*a* on which there are located four pins 10 which are adapted to project through complementary apertures 11 in cover 3. The fastening of the sleeve 3 to the cover 3 is effected through the upsetting of pins 10. Furthermore, two projections 12 of different lengths are provided on flange 9*a*, which extend through recesses 13 in the cover. The lengthier of the projections serves as a stop for limiting the angle of rotation of nut 5. The sleeve 9 may be fastened in two 180° offset positions in the cover so that the lock is adapted to be employed for either right-and-left hand latching of the door.

Within the cylindrical portion of sleeve 9 there are located three lugs 14, which are separated from the remainder of the sleeve through the intermediary of two parallel slots 15. The lugs 14, after introduction of the sleeve 9 into the aperture 16 in door 17, are outwardly spread by means of a suitable special tool, whereby the sleeve 9 and the entire lock therewith are fastened to the door.

Interiorly of sleeve 9 there are further provided two axially extending lower and upper grooves 18 and 19. The lower groove 18 is somewhat wider than the upper groove 19. Furthermore, the sleeve 9 includes two radially inwardly extending projections 20. The grooves 18, 19, and the projections 20, serve for effecting the guidance and fastening of the various types of actuating fittings or members for the lock as shown in FIGS. 1*a* through 1*d*.

Figure 1A:
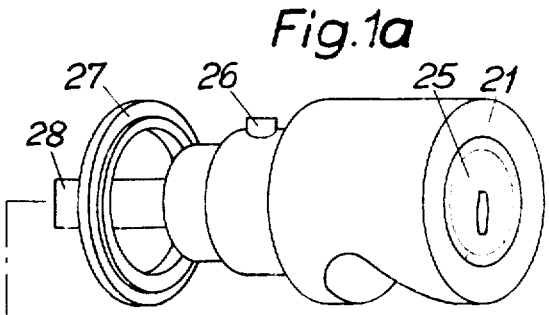
Figure 6:
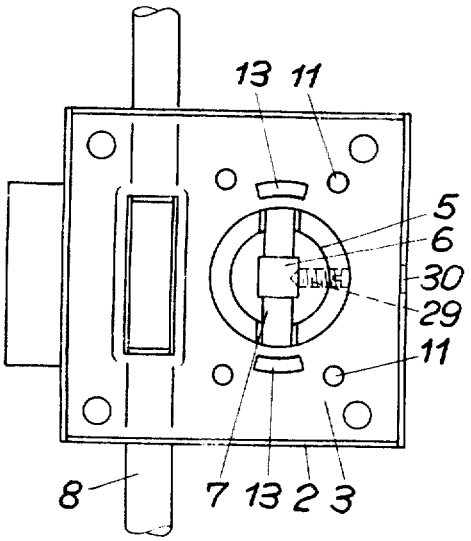
FIG. 6 is a front view of an espagnolette lock shown with the lock sleeve removed.

Thus, illustrated in FIG. 1a is a commercially available olive 21 with a built-in safety cylinder 25, which may be actuated by means of a flat key. The safety cylinder 25 actuates the radially displaceable locking bolt 26. The olive 21, through the intermediary of a plastic material ring 27, may be inserted directly into the sleeve 9. The rectangular arbor 28 extends into the rectangular aperture 6 in nut 5 (refer to FIG. 6). The rectangular arbor is then grippingly clamped by means of a screw 29 which is located in a radial hole formed in nut 5. This screw is accessible through an aperture 30 which is formed in the side wall of the lock box 2, as indicated in FIG. 6. In the locking position, the locking bolt 26 extends into the groove 19 of the sleeve 9, so as to prevent rotation of the olive 21.

Figure 1B:
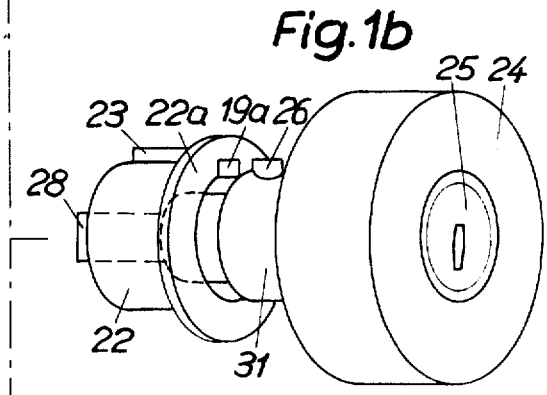

In FIG. 1b there is illustrated an olive 24 having another common commercially construction. The olive may also be constructed as a rotary grip. The portion 31 which is adapted to be inserted into sleeve 9 has a smaller diameter than the olive shown in FIG. 1*a*, and a reducing sleeve 22 which has a flange 22*a* is inserted in the sleeve 9. The reducing sleeve 22 includes a wedge-like axially extending projection 23, which extends into the groove 19 in sleeve 9. A groove 19*a* in the reducing sleeve 22 is adapted to receive the locking bolt 26, in the event that olive 24, as illustrated, is provided with a safety cylinder 25. The rectangular arbor 28 is, in a similar manner as shown with respect to the olive 21 in FIG. 1*a*, fastened in the nut 5.

Figure 1C:
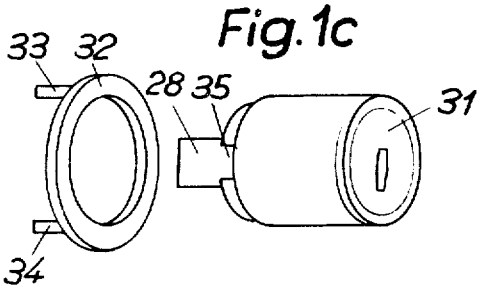

Illustrated in FIG. 1*c* of the drawing is a usual commercial safety cylinder 31, whose inner cylinder may be rotated by means of a key, so that its rectangular arbor 28 will concurrently rotate therewith. The cylinder 31 has a smaller external diameter than the inner diameter of sleeve 9. For this reason, a rossette 32 having two projections 33, 34 is previously introduced into the sleeve 9. The projections 33, 34 thereby extend into the grooves 18, 19 of sleeve 9 and support the rossette with a gripping engagement. The cylinder 31 is then introduced into the rossette 32, so that the rectangular arbor 28 extends into the rectangular aperture 6 in nut 5, and may be fastened therein in the previously described manner. The cylinder 31 includes two recesses 35. Into these, in the mounted position, there extend the two projections 20 in the sleeve 9, so that cylinder 31 is also secured against rotation.

Figure 1D:
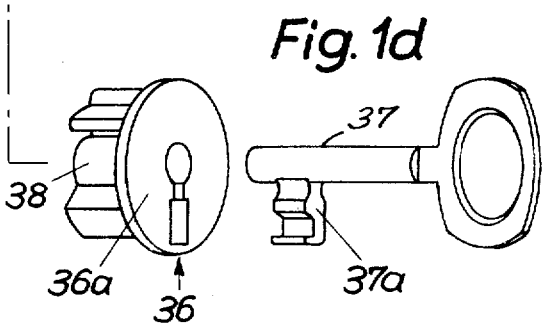
Figure 5:
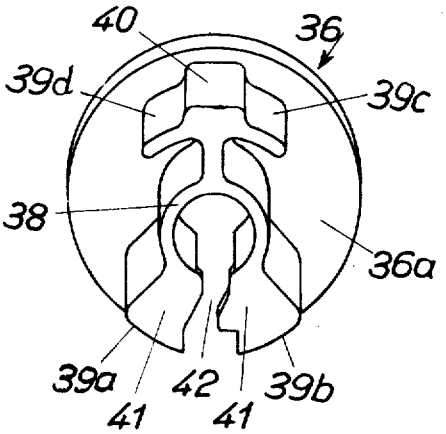
FIG. 5 is a perspective view of a key shield.

Illustrated in FIG. 1*d* is a key shield 36 which is adapted to be built into the sleeve 9, and which may be utilized in conjunction with a cipher key 37. The key shield 36 is separately illustrated in FIG. 5. The key shield includes a circular plate 36*a* from which projects a shaft 38. The latter includes four flats 39*a*, 39*b*, 39*c* and 39*d* which, in the built-in condition, are placed in a gripping engagement with the sleeve 9. Thereby, a wedge-like projection 40 engages in groove 19 of sleeve 9. At the rear end of the shaft 38 there is located a plate 41 which includes an aperture 42 in conformance with the shape of the key bit 37*a*. The difference in locking is thus provided by the plate 41. The key 37 and the key shield 36 are the only components which must be produced in various kinds of shapes and held in storage. Their number depends upon the various key bit shapes which are offered for sale. All forms of key bits 37*a* can readily extend into the slot 7 of nut 5, and rotate the latter for effecting opening and locking of the lock.

By means of the above-described construction it thus becomes feasible that the finally mounted lock 1 be subsequently fitted in a simple manner with any of the actuating elements illustrated in FIGS. 1*a* through 1*d*.

The mounting of the lock 1, through insertion of the sleeve 9 into the door aperture 16 and the spreading of lugs 14 may even be automatically carried out by means of suitable devices. Naturally, the lock 1 may also be fastened to a door in the heretofore usual manner through the employment of four screws.

While there has been shown what is considered to be the preferred embodiment of the invention, it will be obvious that modifications may be made which come within the scope of the disclosure of the specification.

What is claimed is:

1. Espagnolette lock for the latching of doors and the like, comprising a lock box; a lock box cover; an actuating nut rotatably supported on the wall of said lock box and in said lock box cover, said actuating nut including a rectangular through-aperture for receiving a rectangular arbor, and a slot formed in one side of said nut for receiving the key bit of a cipher key; and a sleeve adapted to be mounted in a circular aperture formed in the door, said sleeve including guide grooves and projections for receiving and securing of varied actuating elements for said lock and guide and cover sleeves associated therewith.

2. A lock as claimed in claim 1, said sleeve including plastically deformable spreader lugs for securing said sleeve in said door aperture.

3. A lock as claimed in claim 1, comprising a reducing sleeve having a wedge-like projection being insertable into said first sleeve; and wedge-like projection extending into one said groove of said first sleeve, and a groove being formed in said reducing sleeve for receiving a locking bolt of an olive having a safety cylinder.

4. A lock as claimed in claim 1, comprising a rosette adapted to be positioned in said sleeve, said rosette having two projections extending into said guide grooves, and a safety cylinder being mountable in said rosette, said safety cylinder having recesses for receiving the projections of said sleeve.

5. A lock as claimed in claim 4, comprising radially extending locking screw means in said nut for securing said rectangular arbor to said nut.

6. A lock as claimed in claim 1, comprising a key shield having a shaft being inserted into said sleeve; and a plate being located at the rear end of said shaft, said plate having aperture in conformance with the bit configuration of a cipher key.

7. A lock as claimed in claim 6, said key shield shaft being mounted in said sleeve in gripping engagement therewith.

* * * * *